US007898489B2

(12) United States Patent
Mäkinen et al.

(10) Patent No.: US 7,898,489 B2
(45) Date of Patent: Mar. 1, 2011

(54) BEAM ADJUSTING DEVICE

(75) Inventors: Jarmo Mäkinen, Vallentuna (SE); Olov Ekervik, Vallentuna (SE); Daniel Åkesson, Hässelby (SE); Tord Liljevik, Bromma (SE); Johan Dagerhamn, Åkersberga (SE); Erik Östlind, Åkersberga (SE)

(73) Assignee: Powerwave Technologies Sweden AB, Kista (SE)

( * ) Notice: Subject to any disclaimer, the term of this patent is extended or adjusted under 35 U.S.C. 154(b) by 57 days.

(21) Appl. No.: 11/920,885

(22) PCT Filed: May 31, 2006

(86) PCT No.: PCT/SE2006/000640

§ 371 (c)(1),
(2), (4) Date: Jul. 7, 2009

(87) PCT Pub. No.: WO2006/130083

PCT Pub. Date: Dec. 7, 2006

(65) Prior Publication Data

US 2009/0278761 A1 Nov. 12, 2009

Related U.S. Application Data

(60) Provisional application No. 60/685,545, filed on May 31, 2005.

(30) Foreign Application Priority Data

May 31, 2005 (SE) ..... 0501235

(51) Int. Cl.
*H01Q 3/00* (2006.01)
*H01Q 1/00* (2006.01)

(52) U.S. Cl. ..... 343/757; 343/766; 343/904

(58) Field of Classification Search ..... 343/757, 343/758, 766, 904
See application file for complete search history.

(56) References Cited

U.S. PATENT DOCUMENTS 5,623,270 A 4/1997 Kempkes et al.

(Continued)

FOREIGN PATENT DOCUMENTS

DE 202 16 431 U1 3/2003

(Continued)

OTHER PUBLICATIONS

International Search Authority, Written Opinion for International Application No. PCT/SE2006/000640 dated Sep. 27, 2006, 5 pages.

(Continued)

*Primary Examiner*—Shih-Chao Chen
(74) *Attorney, Agent, or Firm*—OC Patent Law Group

(57) ABSTRACT

The present invention relates to a device for adjusting the beam direction of a beam radiated from a stationary array of antenna elements. Antenna element feed points are coupled to a common source via a feed line structure having a source connection and feed connection terminals to be connected to the antenna element feed points, the feed line structure being at a distance from and in parallel to a fixed ground plane. A movable element is located adjacent to the feed line structure to change the signal phase of signal components being transferred between the source connection and the respective feed connection terminals. The movable element is movable for effecting a phase shift of the signal components to adjust the beam direction. The device is provided with a detection arrangement for detecting the absolute position of the movable element.

25 Claims, 6 Drawing Sheets

U.S. PATENT DOCUMENTS

| | | | | |
|---|---|---|---|---|
| 5,801,600 | A | 9/1998 | Butland et al. | |
| 6,198,458 | B1 | 3/2001 | Heinz et al. | |
| 6,441,700 | B2 * | 8/2002 | Xu | 333/161 |
| 6,621,465 | B2 * | 9/2003 | Teillet et al. | 343/797 |
| 6,850,130 | B1 | 2/2005 | Gottl et al. | |
| 7,026,889 | B2 * | 4/2006 | Sledkov | 333/128 |
| 2001/0033247 | A1 | 10/2001 | Singer et al. | |

FOREIGN PATENT DOCUMENTS

| | | | |
|---|---|---|---|
| EP | 0 575 808 | A | 12/1993 |
| WO | WO-96/37922 | A1 | 11/1996 |
| WO | 98/21779 | A | 5/1998 |
| WO | 02/37656 | A | 5/2002 |
| WO | WO-02/35651 | A1 | 5/2002 |
| WO | 2005/004281 | | 1/2005 |

OTHER PUBLICATIONS

International Search Authority, International Search Report for International Application No. PCT/SE2006/000640 dated Sep. 27, 2006, 5 pages.

Supplemental European Search Report pertaining to European Patent Application No. 06747834 mailed May 26, 2009.

* cited by examiner

7a
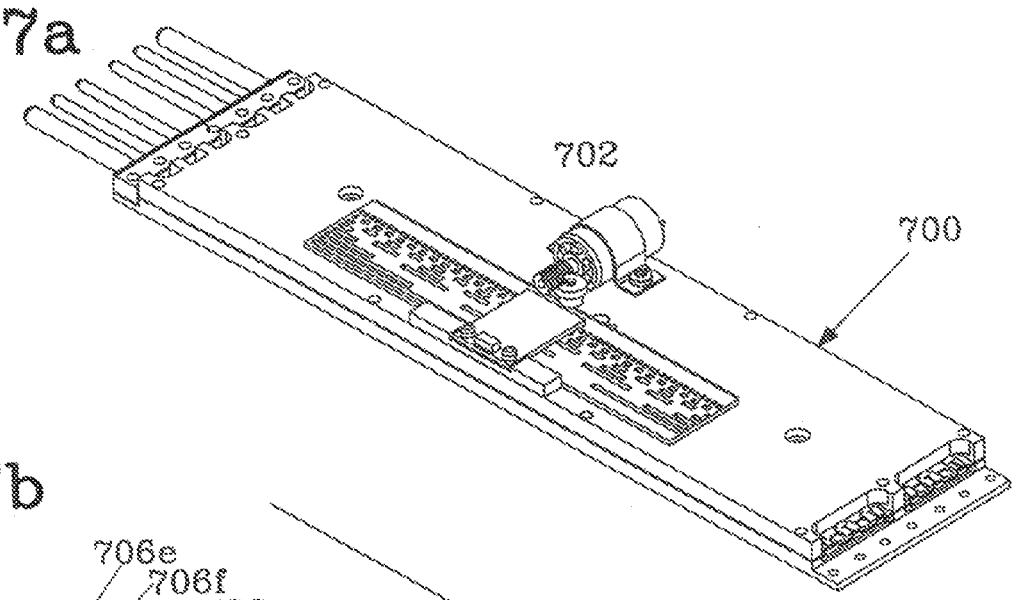
7b
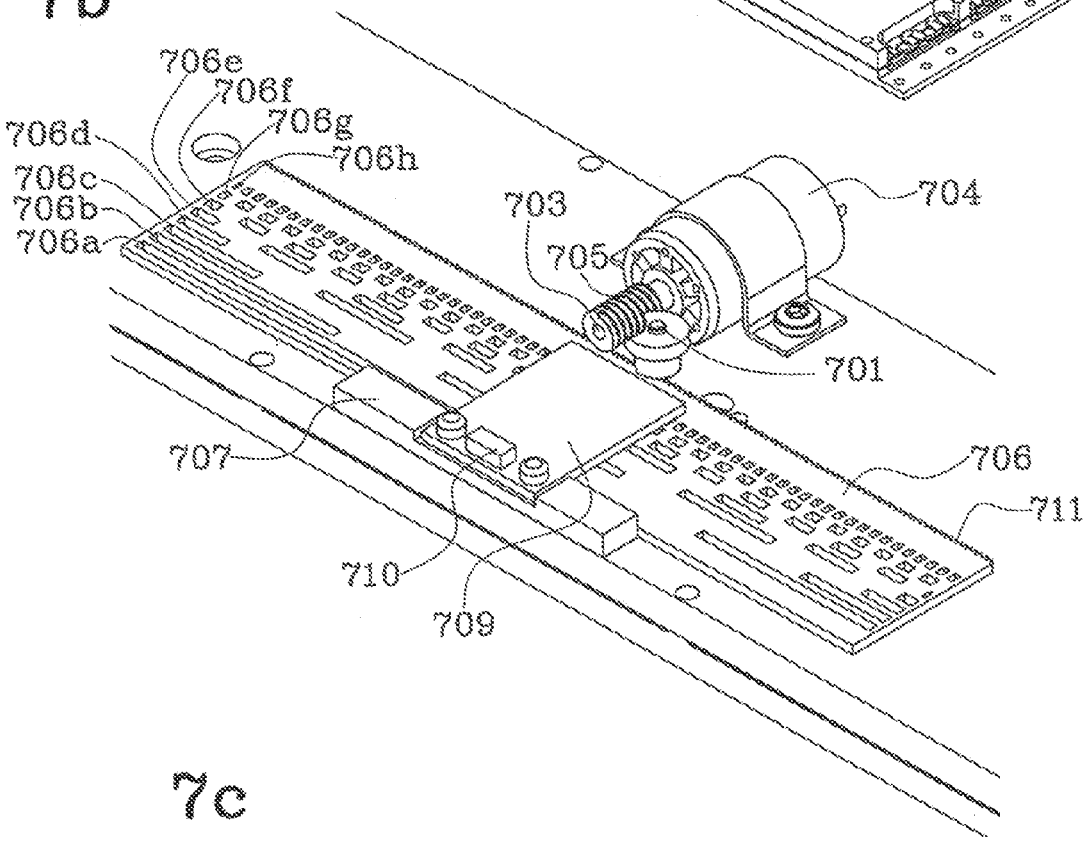
7c
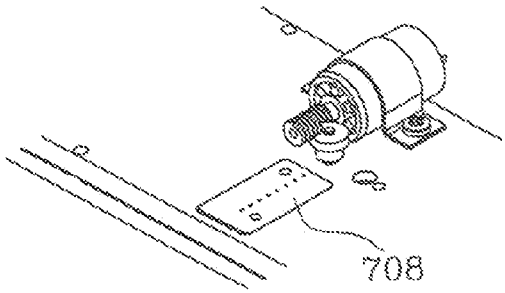

BEAM ADJUSTING DEVICE

This application claims priority to U.S. Provisional Application No. 60/685,545 filed May 31, 2005.

FIELD OF THE INVENTION

The present invention relates to a device for adjusting the beam direction of an antenna. More particularly, the device is of the kind defined in the preamble of claim 1.

The present invention also relates to an antenna control system for adjusting the beam direction of an antenna. More particularly, the system is of the kind defined in the preamble of claim 24.

RELATED ART AND BACKGROUND OF THE INVENTION

Such devices are previously known from the documents WO 96/37922 (Allgon AB) and WO02/35651 A1 (Allgon AB). The device known from WO 96/37922 comprises a feed line structure integrated with a stationary array of antenna elements so as to enable adjustment of the direction of the beam radiated from the array. The feed line structure includes a feed conductor line pattern disposed on a fixed dielectric carrier plate at a distance from and in parallel to a fixed ground plate. The feed line structure is disposed on the carrier plate surface facing away from the ground plate. A movable dielectric plate is located between the carrier plate and the ground plate. The feed line pattern is elongated in the same direction as the movement direction of the dielectric plate. The propagation velocity of the signal components is reduced by the presence of the dielectric plate between the respective feed line and the ground plate. Accordingly, by displacing the dielectric plate in the longitudinal direction, the phase difference between the various signal components may be controlled. A problem with the device described in WO 96/37922 is that the influence on the signal phase, and thus the beam angle, is relatively low.

WO02/35651 A1 relates to a device for adjusting the beam direction of an antenna comprising a plurality of antenna elements coupled to a common signal source by means of a feed line structure consisting of punched metal lines. The feed line structure is extended in a main direction and positioned in parallel to one or two ground planes, wherein a movable dielectric element is located between the feed line structure and each ground plane in order to achieve a controlled phase shift to thereby adjust the beam direction of the antenna. The dielectric element consists of different portions having different effective dielectric values. A problem with the device described in WO02/35651 is mechanical tolerances.

A problem with both of the above described solutions is that it is difficult to ensure that an intended beam tilt angle actually results in a set beam tilt angle corresponding to the intended beam tilt angle.

Aim and Most Important Features of the Invention

It is an object of the present invention to provide a device for adjusting the beam direction of a beam radiated from a stationary array of antenna elements that solves the above mentioned problem. In particular, it is an object of the present invention to provide a device for adjusting the beam direction of a beam radiated from an array of antenna elements that is capable of ensuring that an intended beam tilt angle actually results in a set beam tilt angle corresponding to the intended beam tilt angle.

This object is achieved by a device according to the characterizing portion of claim 1.

It is a further object of the present invention to provide an antenna control system for adjusting the beam direction of a beam radiated from a stationary array of antenna elements that solves the above mentioned problem.

This object is achieved by a system according to the characterizing portion of claim 24.

The device for adjusting the beam direction of a beam radiated from a stationary array of antenna elements is characterised in that said device is provided with detection means for detecting the absolute position of a movable element, said beam direction being dependent on the position of said movable component.

This has the advantage that it at all times can be ensured that an intended beam direction also is the set beam direction without having to, as in the prior art, detect the end positions of the movement of a movable element and then interpolate a desired tilt angle. In particular, the absolute position detection has the advantage that when the beam tilt is remotely controlled, an antenna arrangement having a device according to the present invention can be provided with means for providing a set beam direction to a remote control center, whereby the absolute position detection ensures that the reported beam direction corresponds to the actual beam direction.

The device for adjusting the beam direction of a beam radiated from a stationary array of antenna elements may further be characterised in that the device includes means for allowing said ground plane to be positioned relatively close to said feed line structure without risking accidental contact between said feed line structure and said ground plane. Said means may consist of a non-conductive film or layer positioned between said feed line structure and said ground plane.

Being able to arrange the feed line structure closer to the ground plane without the feed line structure and the ground plane accidentally coming into contact with each other, e.g. as a result of heat expansion of the feed lines, or presence of water drops, has the advantage that the device can be made considerably smaller as compared to the prior art, while at the same time keeping or improving the performance of the device and the range of the electrical tilt. This is particularly advantageous since mechanical tilt is prohibited in certain areas, which increases the demand on the range of the electrical tilt.

The present invention further has the advantage that the requirements of the feed line structure can be lowered, e.g. the structure can be made flexible since, due to the protection by the non-conductive film or layer, the flatness requirements of the feed line structure are substantially reduced or eliminated.

The relatively thin non-conductive film or layer may be positioned between said feed line structure and said dielectric element. Said feed line structure may further consist of a relatively thin conductive film or layer, and/or said non-conductive film or layer may be relatively thin.

This has the advantage that the non-conductive film or layer may function as a dielectric barrier, which in turn makes the device less sensitive of air gaps between the dielectric element and the feed line structure. Further, the non-conductive film or layer can provide a dielectric element sliding surface, which reduces friction, protects the feed line structure from wear and which secures the feed line structure from intermodulation. Consequently, no loss-related surface treatment of the feed line structure is necessary.

The feed line structure may be screen-printed onto the non-conductive film, or attached to the non-conductive layer or film, e.g. by gluing or bonding. Alternatively, the feed line structure may be etched on a printed circuit board (PCB), the PCB constituting the non-conductive film or layer. This has the advantage that a feed line structure with a small feed line thickness may be used as the feed line structure need not be self-supporting. Use of an ordinary PCB has the advantage that better tolerances and less costly manufacturing is achieved as compared to solutions of the prior art. Further, normal etch tolerances instead of punching tolerances may be used, which has the further advantage that it is considerably easier to manufacture optimal feed line patterns, e.g. meander shaped feed lines. Even further, mechanical stresses are reduced. Another advantage with this solution is an increased possibility to choose feed line impedance and shape, resulting in achievement of better RF Performance. Further, a larger tilt range can be achieved, e.g. by meander shaped feed line(s). Also, due to the possibility of choosing feed line impedance, an unequal split of input power is easier to accomplish, thereby facilitating amplitude tapering.

Even further, the non-conductive film or layer is a better heat conductor than the surrounding air, which results in a device with a better power durability.

A fixed ground plane may be arranged on both sides of said feed line structure, the feed line structure being parallel to said ground planes, wherein non-conductive films are positioned between said feed line structure and each ground plane, and wherein a dielectric element is positioned between each ground plane and each non-conductive film or layer. This has the advantage that the ground planes may be used as housing of the device, and the device may thus be made very compact. Further, since the present invention enables that the ground planes may be positioned close to the conductive layer, a wider range of feed line impedances may be used as, due to the shorter distance to ground, feed line impedance becomes more depending on the width of the conductors. Further, use of an etched feed line structure allows narrower feed lines as compared to the prior art, which accordingly increases the range of possible feed line impedances even further.

The dimensions of the non-conducting layer(s) may substantially correspond to the dimension of the ground plane(s). Further, at least one portion of the non-conducting layer(s) may be cut-out or cut-away so as to ensure that at least one well defined contact surface between the ground planes and/or feed line connection terminals can be established. Alternatively, the dimensions of the non-conductive film or layer may be such that the ground planes may contact each other at the edges along their entire length and width. This has the advantage that intermodulation may be suppressed and kept at a low level.

As stated above, at least one of said feed lines may be meander shaped. This has the advantage that a greater beam adjusting range may be obtained without increasing the length of the device, or even while reducing the length of the device.

The inner surface of said ground plane(s) may be anodized or provided with a non-conductive layer so as to provide an extra isolating layer. This has the advantage that the risk of undesired contact between feed line structure and ground plane, e.g. due to defects in the non-conducting film or layer, is reduced.

The non-conducting film(s) or layer(s) may have at least one of the further features: water repelling, temperature resistant, low RF losses, a dielectric constant that is lower than the dielectric constant of the dielectric element, low thermal expansion, high thermal conductivity, and a low absorption of moisture.

Commonly used materials, e.g., Teflon®, which is a trademark of E.I. Dupont, which is an isolating material with low E and low losses, may be used. Alternatively, plastic materials such as Ultem® or Lexan®, which are trademarks of the General Electric Company, may be used. Of course, other materials may be used as well.

The device is particularly suitable for use in an antenna control system for adjusting the beam direction of an antenna. In particular, the device is suitable for use in an antenna control system for remote setting of the tilt angle of a main lobe of an antenna array.

These and other features of the invention will become apparent from the detailed description below.

The invention will be explained more fully below with reference to the appended drawings illustrating some preferred embodiments.

BRIEF DESCRIPTION OF THE DRAWINGS

FIGS. 7*a-c* show an alternative exemplary embodiment of the present invention.

DETAILED DESCRIPTION OF PREFERRED EMBODIMENTS

Figure 1:
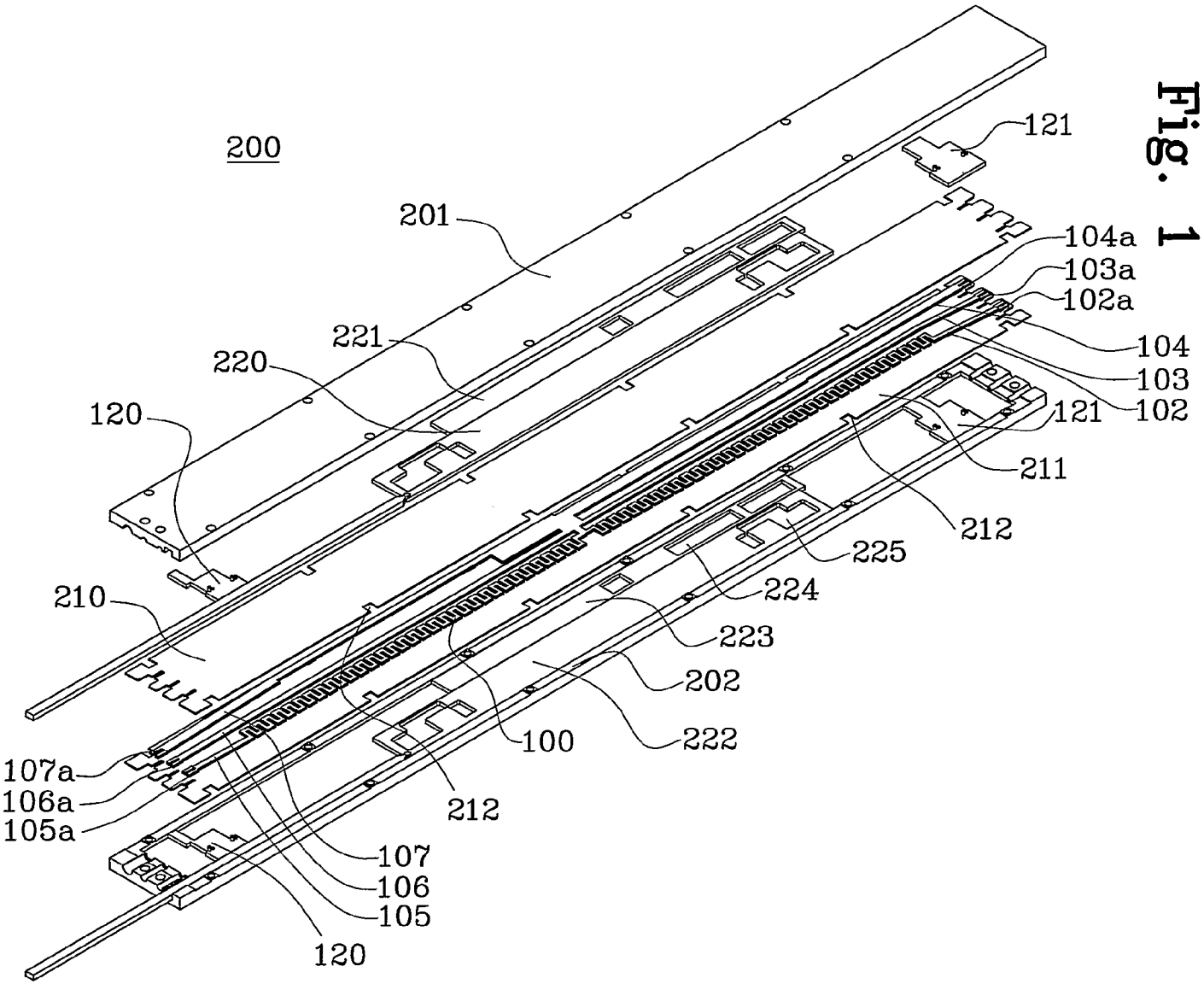
FIG. 1 shows an exemplary embodiment of a phase shifter device in an exploded view.
Figure 2:
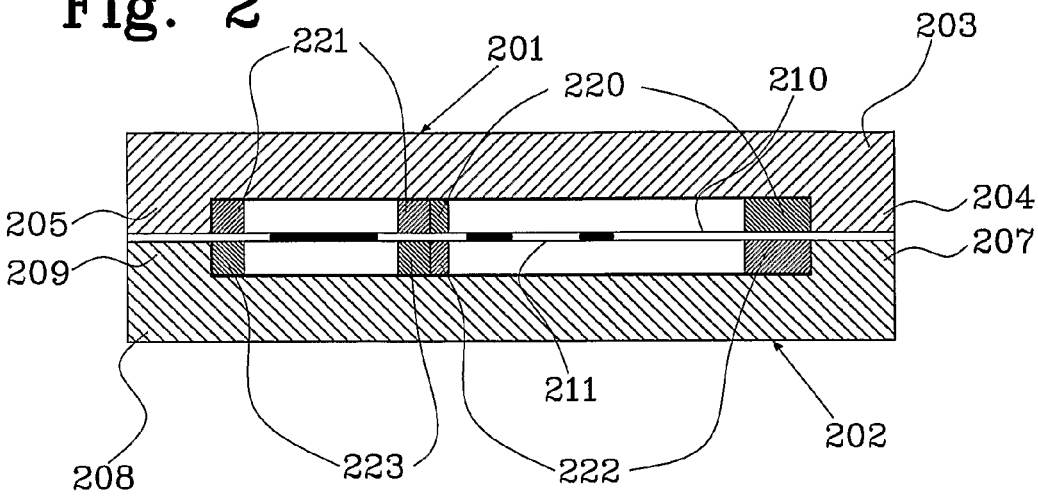
FIG. 2 shows the device of FIG. 1 in a sectional view.

In FIGS. 1 and 2 are shown an exemplary device 200 with which the present invention may be utilised. In FIG. 1 is shown an exploded view of the device for adjusting the beam direction of a beam of an antenna. The device 200 comprises an elongated box-like housing consisting of an upper part 201 and a lower part 202, constituting ground planes. A feed line structure 100 is also shown. Each feed line segment 102-107 of the feed line structure is connected to an associated feed connection terminal 102*a*-107*a*. The feed connection terminals 102*a*-106*a* are connected, e.g. by coaxial cables (not shown), to associated antenna elements or sub-arrays, e.g. pairs of antenna elements, arranged in a stationary array, normally a linear row, in an antenna, e.g. a base station antenna. In use, the feed connection terminal 107*a* is connected, e.g. by a coaxial cable, to transceiver circuits (not shown), e.g. included in a base station of a cellular mobile telephone system.

Figure 3:
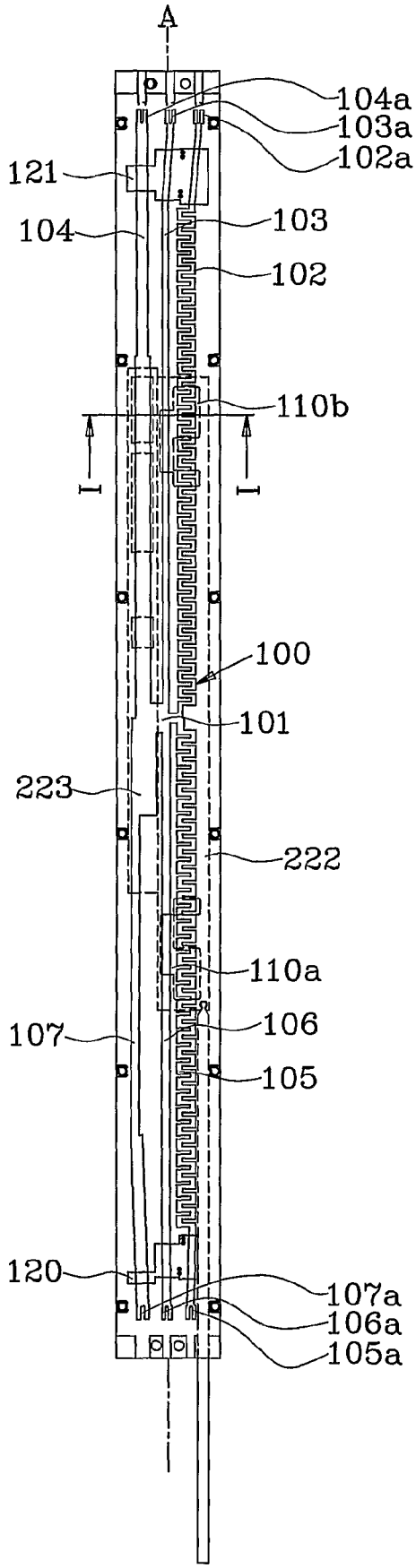
FIG. 3 shows the feed line structure of FIG. 1 more in detail.

In FIG. 2 is shown an expanded section of the assembled device along the line I-I in FIG. 3. As is shown in the figure, the upper part 201 includes a substantially planar top wall 203 and, integral therewith, two downwardly directed, longitudinally extending flanges 204, 205. The lower part 202 of the housing includes a substantially planar bottom wall 208 and, integral with the longitudinal edge portions of the bottom wall 208, upwardly directed flanges 207 and 209. The feed line structure 100 is arranged between two non-conducting films or layers 210, 211, the length and width of which substantially corresponding to the dimension of the upper and lower ground planes 201, 202, as can be seen in FIG. 1. The thickness of the non-conducting films or layers may be, e.g. in the order of 0.01-1 mm. This has the advantage that the non-conducting films or layers isolates the ground planes from each other, which has as result that intermodulation can be suppressed and kept at a low level. Further, a non-conducting film or layer having a dimension corresponding to the dimension of the upper and lower ground planes 201, 202 has the advantage that the upper and lower ground planes 201, 202 may constitute a mounting framework onto which the non-conducting film or layer can be affixed. The ground planes can be affixed to each other by fastening means, e.g. in form of screws in a manner known per se. In order to keep the ground planes isolated from each other, the screws may be of a non-conducting kind, e.g. plastic screws. Alternatively, ordinary (conducting) screws may be used, in which case the present invention has the advantage that only predetermined and distinct contact areas between the ground planes are used, which has intermodulation advantages. The non-conductive layers may have through-holes corresponding to the diameter of the screws, or, alternatively, the non-conducting layers may be provided with, preferably well-defined, cut-outs (indicated in FIG. 1 as 212) at the localisations of the affixing points. In order to facilitate the assembling of the device, the feed-line structure and the non-conducting layers can be glued together prior to the assembling. Alternatively, the feed line may be obtained by etching of a non-conducting film or layer comprising a conducting layer. The second non-conducting film or layer may then be attached, e.g. by gluing or bonding with prepreg, to the conducting-layer-side of the first non-conducting film or layer. As another alternative, one or both non-conducting films may be self-adhesive on one side, so that when the films are put together, with the feed line structure in-between, the films and the feed line structure is assembled to a unit that is easy to handle when assembling the device. In yet another embodiment, the non-conducting films or layers constitute a single film or layer in which the feed line structure is embedded. In the exemplary embodiment shown in FIG. 1, the feed line structure 100 is affixed to the non-conductive film 211.

Further, in FIGS. 1 and 2 are shown dielectric elements 220-223, which are used to influence the propagation velocity. Dielectric elements 221, 223 are optional and, if used, they can be used e.g. to reduce impedance in the feed conductors 104 and 107. Dielectric elements 220, 222 are used to influence the phase shift of the signal components being transferred along the respective line segments by being linearly displaceable along the longitudinal direction of the device between two end positions, as is known in the art, e.g. from WO02/35651 A1, and as will be explained further below, in order to change the phase angle differences between the signal components at the feed connection terminals. The phase angle differences will depend on the particular position of the dielectric element. When the dielectric element is displaced a certain distance, the transmission phases of line segments 102, 103, 105, 106 will be changed uniformly, while the transmission phase of line segment 104 remains substantially unchanged. If the phase shift of feed lines 102, 105 is twice that of the feed lines 106, 103, the phase angle difference between the terminals associated with adjacent antenna elements (or sub-arrays) will be mutually the same. Therefore, the composite beam from the five antenna elements coupled to these terminals will in such a case always have a wave front substantially in the form of a straight line, and the inclination of this wave front can be adjusted by displacing the dielectric element to a different position in the longitudinal direction of the device.

The dielectric elements may have different effective dielectric values, e.g. by providing part of the dielectric element with through-going holes, other irregularities or varying thicknesses in order to affect the retarding effect of the dielectric material. This is indicated in the figures, for example by the through-going holes 224, 225. Of course, the dielectric elements may be solid with equal dielectric values.

The dielectric elements can serve as spacing elements so as to keep the feed line structure in position. In an alternative embodiment, the top and bottom walls may be provided with positioning elements, e.g. in form of projections or walls, which may aid the dielectric elements in holding the feed line structure in position and ascertain a correct distance between the feed line conductors and the ground planes.

The use of the non-conductive layers has the advantage that the ground planes can be located close to the conductive layer without risking that the feed line conductors come into contact with the ground planes, e.g. due to water drops or due to deformations caused by heat expansion during use, with advantages as described above.

In an exemplary embodiment, the inner surface of the top and bottom walls and the flanges are anodized in order to provide an extra isolating layer for extra protection against undesired contact between the ground planes and the feed line structure. Instead of being anodized, the surfaces may be coated with a non-conductive coating.

In FIG. 3 is shown the feed line structure 100 of FIG. 1 more in detail. In the illustrated embodiment, the feed line structure 100 is configured with first and second line segments 105, 106 extending in a first direction, together with a feed conductor 107 along the main direction A of the device, and third, fourth and fifth line segments 102, 103, 104 extending in a second direction being opposite to the first direction. Each feed line segment is connected to an associated feed connection terminal 102*a*, 103*a*, 104*a*, 105*a* and 100*a*, respectively. The feed line segments are interconnected by a source connection terminal 101, which is connectable to a signal source by means of the feed conductor 107, and its associated feed terminal 107*a*. The feed connection terminals 102*a*-106*a*, are, as mentioned above, connected, e.g. by five coaxial cables, to associated antenna elements or sub-arrays.

A microwave signal appearing at the feed terminal 107*a* will propagate along the feed conductor 107 to the centrally located source connection terminal 101 and on to the five line segments 102-106. In order to adjust the down tilt, the displaceable dielectric elements 220, 222, of which 222 is indicated by dashed lines, partially covering the feed lines 102, 103, 105, 106, is slid along the feed lines in the main direction A. As is shown in the figure, the dielectric element 220 may be provided with through holes 110*a*, 110*b* in order to match the dielectrically loaded portions of the feed lines to the portions without dielectric loading. The dielectric element 223 is also indicated.

The device may further be provided with stationary dielectric elements 120, 121 (shown in FIGS. 1 and 3) near or at the ends of the device in order to match the impedance of the feed line segments to the connection terminals. As is shown in the figure, these may be of various shapes. The stationary elements may also have various thicknesses.

As is shown in the figure, the two feed lines 102, 105 are meander shaped. This has the advantage that a greater beam adjusting range can be obtained without increasing the length of the device. In an exemplary embodiment, the device could be made considerably shorter and at the same time provide a tilting angle interval twice as great as that of a prior art device.

Preferably, the dielectric material of the dielectric elements has a dielectric constant that is higher than the non-conductive film(s) or layer(s). A suitable material is Ultem®, or Lexan®, which are trademarks of the General Electric Company. In an exemplary embodiment, the dielectric constant of the dielectric material should be in the interval between 2 and 6 (the dielectric constant of the non-conducting film or layer should preferably be relatively low, e.g. ≦3). Further, the dielectric elements preferably should have, as the material of the non-conducting films or layers, low RF losses, be temperature-resistant, have a high thermal conductivity, have low absorption of moisture and have a low thermal expansion.

Figure 4A:
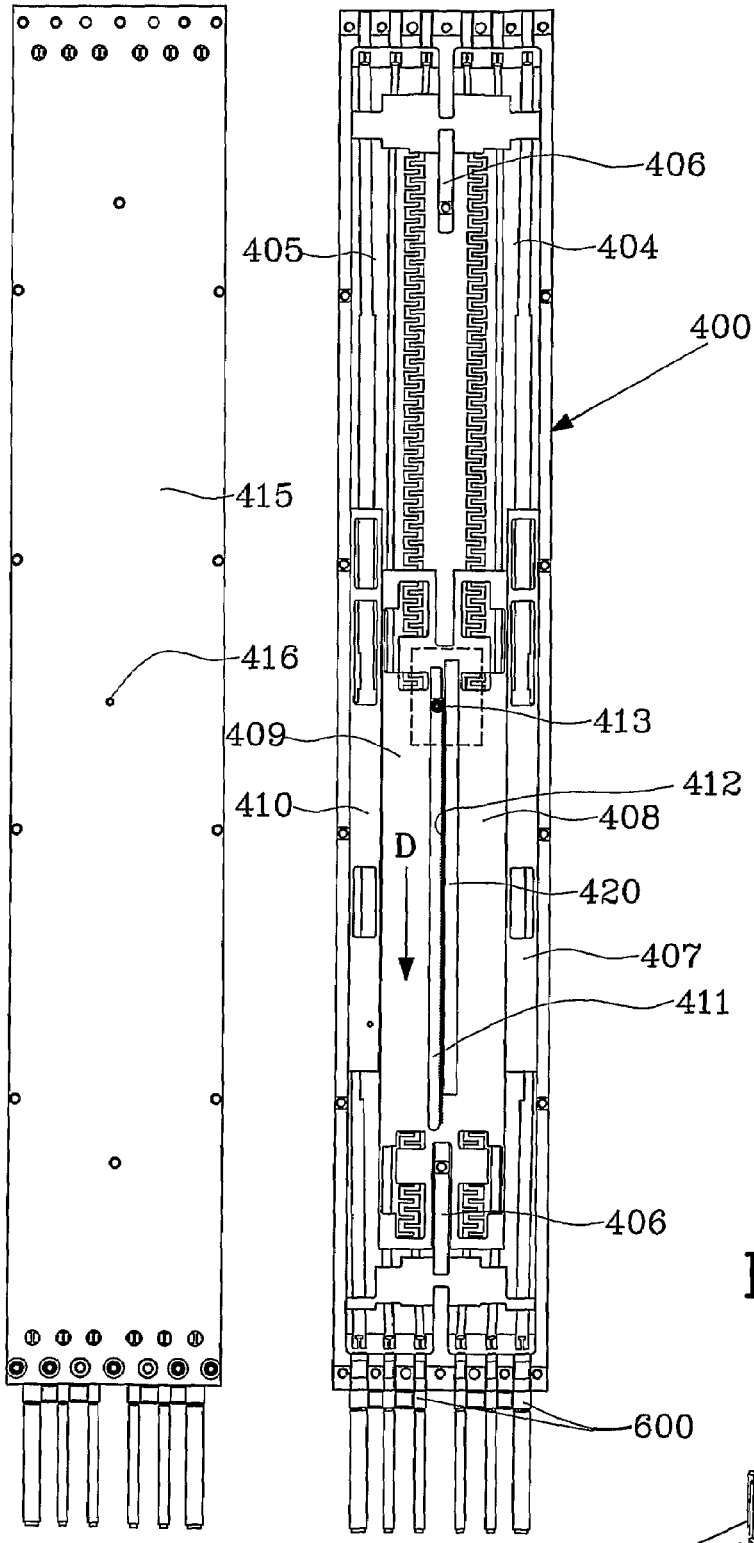
FIGS. 4*a-b* show an exemplary embodiment of the present invention.

In FIG. 4*a* is shown an exemplary embodiment of a device 400 according to the present invention, which is suitable for use with dual polarised array antennas or two separate antenna arrays. The structure of the device 400 regarding arrangement of ground planes, feed line structure, dielectric elements and non-conducting films or layers is similar to the device 200. In this embodiment, however, two feed line structures 404, 405 are enclosed in the housing. The feed line structures 404, 405 are separated by an intermediate flange 406, which has the function of the flanges 207, 209 described above. As can be seen in the figure, the intermediate flange 406 only extend along parts of the device in this embodiment, the reason for this will be explained below. As described above, each feed line structure 404, 405 is arranged between two non-conducting films or layers, the length and width of which, as described above, substantially correspond to the dimension of the upper and lower ground planes. Consequently, the two feed line structures may be positioned between the same non-conductive films or layers, the films or layers and feed line structures thus being manufacturable as a single component.

Alternatively, each feed line structure may be positioned between separate non-conducting films or layers, each covering half the width of the device. In the latter case, the films and the feed line structure may be assembled to a single unit which is equally usable on the embodiment described in FIGS. 1-3 as in the embodiment described in FIG. 4*a*, thus providing manufacturing advantages.

Dielectric elements 407-4-10 (and, correspondingly, in accordance with the device 200, on the opposite side of the feed line structure, corresponding dielectric elements (not shown)) are used as described above, i.e. dielectric elements 408, 409 are used to influence the signal phase in the feed lines. The two feed line structures (and dielectric elements) in FIG. 4*a* are arranged such that the feed line structure 404 (and the dielectric elements 407-408) is a mirror of the feed line structure 405 (and the dielectric elements 409-410). This has as result that the two movable dielectric elements 408 and 409 are mirrored and positioned towards each other. Due to the fact that the intermediate flange only extends along part of the device 400, this solution allows the movable dielectric elements 408, 409 to, as is shown in the figure, be formed as an integral unit which, when moved, simultaneously influences the phase of signal components being transferred along respective line segments of the feed line structures 404, 405. Thus, the synchronous movement of the dielectric elements 408-409 (and corresponding (not shown), dielectric elements on the opposite side of the feed line structure) allows equal control of dual polarised antenna elements or different sets of antenna elements. For example, the dielectric elements 408-409 can be operated by a rod in a manner similar to the embodiment shown in FIGS. 1 and 3.

In the embodiment shown in FIG. 4*a*, however, an alternative exemplary solution to the movement of the dielectric elements is disclosed. The unit consisting of the dielectric elements 408, 409 is provided with a groove 411 of which one edge 412 constitutes a rack to, in a manner obvious and well known to a person skilled in the art, engage a toothed pinion 413 fitted within the groove. This solution is also shown more in detail in FIG. 4*b*, in which the pinion 413 is shown more in detail. As can be seen in the figure, the edge 412 of the dielectric elements 408, 409 engages the toothed pinion 413 such that when the pinion 413 is rotated, this movement is translated to a linear movement of the dielectric elements 408, 409. E.g., a clock-wise rotation of the pinion 413 results in the dielectric elements 408, 409 moving in the direction of arrows D. Consequently, the dielectric elements 408, 409 (and the equally toothed, corresponding dielectric elements on the opposite side of the feed line structure) can be moved simultaneously with perfect synchronisation in a simple manner. Further, the direct connection to the dielectric elements reduces transmission plays.

Figure 4B:
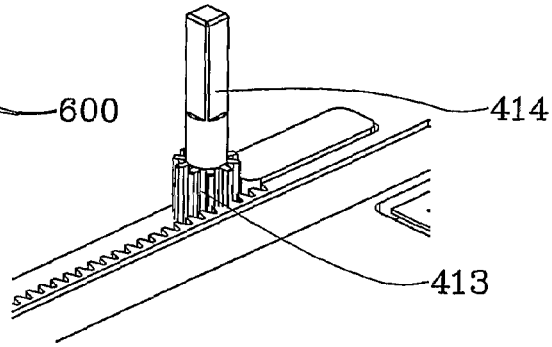

As can be seen in FIG. 4*b*, a shaft 414 of the pinion 413 extends through a hole 416 in the housing (ground plane) 415 so as to be engageable from the exterior of the housing 415. The shaft 414 may, for example, be connected directly to the shaft of a stepping motor, or, alternatively, be connected to a stepping motor via a worm gear. In particular the worm gear solution (or any toothed gear or angular gear solution for that matter) has the advantage that the dimension of the stepping motor can be made very small, at least if a suitable gear ratio is selected, as it only needs to provide torque enough to move the dielectric elements 408-409 (and corresponding elements as described above). This is a significant advantage as compared to the prior art, since the providing of sufficient power supply to the stepping motor and associated control electronics can be complicated. In the prior art, considerably larger components, such as rods and other linkage, have to be moved, which in turn requires a considerably larger power consumption. Both the stepping motor and its associated control electronics may advantageously be mounted inside the antenna radome.

In an alternative embodiment, the intermediate flange 406 may extend all along the device, the feed line structures thus being located in "separate compartments". In this solution, the edges of the dielectric elements 408, 409 facing each other may be embodied as racks, each for engagement with a toothed pinion. The toothed pinions may be provided in a recess in the intermediate flange and interconnected such that when one pinion is rotated, the other follows, however with each pinion only contacting the rack of one dielectric element. The pinions should therefore be offset somewhat with respect to a central axis extending through the intermediate flange. The interconnection ensures a synchronous movement of the pinions, and thus the dielectric elements. As is obvious to a person skilled in the art, the dielectric elements will move simultaneously in the same direction. As the pinions are interconnected, only the shaft of one pinion needs to be engageable from the exterior of the housing and the device can be operated as described above.

It is, of course, also possible to use both the above described solutions in a device according to FIGS. 1-3. For example, the toothed pinion could be positioned, e.g. at the right most portion of the device 200, in which case the right most sides of the movable dielectric elements 223, 222 would be formed as racks as described above.

As has been stated above, a problem with phase shifters of the above kind is that it is difficult to ensure that an intended beam tilt angle actually results in a set beam tilt angle corresponding to the intended beam tilt angle, e.g., that a SET TILT command will be executed in a correct manner.

The exemplary embodiment of the present invention shown in FIG. 4*a* solves this problem and secures that a set beam tilt equals an intended beam tilt. The movable dielectric elements 408, 409 is provided with a reading scale 420 comprising a grading with a resolution of, e.g., 1/100°. An optical reading device (not shown) is mounted on the exterior of the housing, directly above the reading scale 420 and scans the reading scale 420 through one or more openings in the housing. Consequently, the device is provided with means for detecting the absolute position of the movable dielectric element and, thereby, also the actual beam tilt. This has the advantage that an exact position of the movable dielectric element always can be obtained without, as in the prior art, having to detect the end positions of the movement of the dielectric element and then interpolate a desired tilt angle. Thus, it can be ensured that control signals sent from, e.g., a remote location to a stepping motor control electronics and comprising e.g. a SET TILT=22° command, will be executed in a correct manner.

As an alternative to the optical reading for obtaining the absolute position of the movable dielectric element, the movable dielectric element may be provided with a linear potentiometer, whereby an exact position of the movable dielectric element can be obtained by measuring the resistance of the potentiometer.

Figure 5:
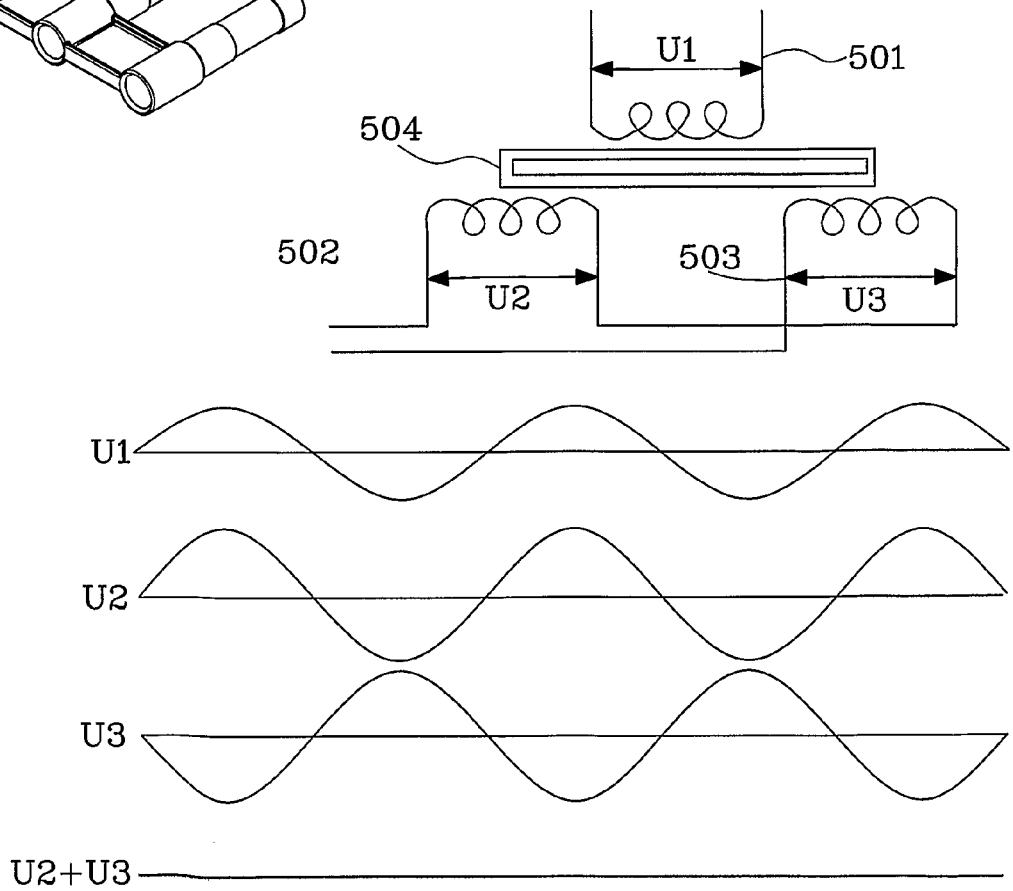
FIG. 5 shows a further feature of the present invention.

As yet another alternative to the optical reading, the reading may be performed by detecting a capacitance or an inductance. For example, a linear variable differential transformer (LVDT) may be used. Such a device may be obtained from RDP Electronics Ltd., and its principle of operation will be described below with reference to FIG. 5. Three coils 501, 502, 503 are wound onto a coil former or bobbin. Coil 501 constitutes a primary coil and is excited with an a.c. current, normally in the region of 1 to 30 kHz at 0.5 to 10V rms. The coils 502, 503 constitute secondary coils and are wound in opposition such that when a ferritic core is in the central linear position, an equal voltage is induced into each coil, and the outputs of the two secondary coils cancel each other out. By using a magnetic material movable part 504 as ferritic core, which in the present invention constitutes part of, is provided on, or connected to the movable dielectric element, movement of the movable part 504 induces currents into the coils 502, 503. As the movable part moves to the left (or right) in the figure, the induced voltage in coil 502 (503 when moving to the right) increases while the induced voltage in coil 503 (502) decreases. The magnitude of the output of the transducer (i.e., the sum of the induced voltages in coils 502, 503) rises linearly when the movable part displaced from the center, electrical zero position. Consequently, the exact position of the movable dielectric element can always be obtained by reading the output voltage. If the movable dielectric element can be moved in both directions from the center position, the phase of the output signal must be considered in order to know the direction of the movement.

In FIGS. 7*a-c* is shown yet another exemplary embodiment of an arrangement for obtaining the absolute position of said movable dielectric element and thereby the actual beam direction without having to perform some sort of end position detections and interpolate the position from there in order to ascertain a desired beam direction. In FIG. 7*a* is shown a phase shifter 700, which is similar to the phase shifter in FIG. 4*a*, i.e., a phase shifter that is suitable for use with dual polarised array antennas or two separate antenna arrays. Accordingly, the phase shifter 700 comprises dielectric elements (not shown) which are engaged by at least one toothed pinion, i.e., when the pinion is rotated, this movement is translated to a linear movement of the dielectric elements.

As can be seen in FIG. 7*a* and more in detail in FIG. 7*b*, which shows an expanded part of the device in FIG. 7*a*, a shaft 701 of the (not shown) pinion extends through a hole in the housing (ground plane) 702 so as to be engageable from the exterior of the housing 702. The shaft 701 is connected to the shaft 703 of a motor 704 by means of a gear 705. Although the motor could be a stepping motor, any electric motor could be used since the present invention obviates the need for counting stepping motor steps, as will be disclosed below. Although the shaft 701 and motor 704 may be connected at a 1:1 ratio, a suitable gear ratio is preferably selected to ensure that the motor is capable of providing torque enough to move the phase shifter dielectric elements and/or allow use of a small motor having low energy consumption.

Further, the shaft 701 of the pinion is in a manner similar to what has been shown in connection with FIG. 4*b* toothed also on the exterior of said housing 702 for engagement with a rectangular plate 706, one edge 711 of which constituting a rack similar to what has been disclosed in FIG. 4*b*, so that when the pinion is rotated, this movement is translated to a linear movement of the rectangular plate 706. If the exterior tooting of said pinion is similar to the interior tooting, and if the rack of said plate and the rack of said dielectric elements are similar, the plate 706 will follow movement of said dielectric elements. The plate 706 abuts a guide element 707 which ensures that movement of said plate in the desired direction, i.e., in the directions of the arrows.

The absolute position detection functions according to the following. As can be seen in FIG. 7*c*, a thin circuit card 708 is arranged on the housing 702 and beneath the plate 706. The circuit card 708 is provided with eight light emitting diodes (LEDs), indicated by dots aligned along an axis transverse to the longitudinal axis of the plate 706. The plate 706 is provided with eight longitudinal rows 706*a-h* of holes. The holes and solid portions there between make up an 8-bit Gray code, e.g., a hole being defined as a logical "1" and a solidness being defined as logical "0", and each row is aligned with a corresponding LED on the circuit card 708. Further, a second circuit card 709, provided with eight sensor means (not shown), such as photo-transistors, is arranged on top of said plate 706 in a manner such that said LEDs and said photo-transistors are aligned in a common plane. In use, LEDs constantly emit light detectable by said photo-transistors. The photo-transistors, however, will only detect light of its corresponding LED, and thereby detect a logical "1", when the "line of sight" is not broken by a solid portion of said plate 706. Consequently, the exact location of the plate 706, and thereby of the movable dielectric elements of said phase shifter 700 can always be determined, even directly at power-up without need of any end position detection since the eight sensors immediately will tell the position of the plate 706. The detected code can be output to control means (not shown), e.g., the motor control means, by means of a signal cable connected to an output 710 of said data card 708. The outputted signal may then be used by the control means to determine the beam direction, e.g., by a table look-up and compare this beam direction with a desired beam direction, e.g., received from a remote location as a SET TILT command, and, if necessary, adjust the current setting by actuating said motor. The data card may further include means for converting the 8-bit parallel signal to a serial signal for safer information transfer. The disclosed embodiment thus provides a simple yet efficient way of determining the position of the dielectric elements in a phase shifter and thereby the beam direction of a beam radiated from antenna elements connected to said phase shifter. Although any binary code system could be used on the plate 706, a Gray code is advantageous since it provides a binary code system wherein two successive values differ in only one digit (i.e., only one hole at a time of holes (or solidnesses) in a transverse row of said rows 706*a-h*) switches to a solidness (or hole) from one transverse row to a following transverse row).

Use of an ordinary binary code has the disadvantage that since more than one position or bit simultaneously may change (cf. the transition 01111111 to 10000000) a stop at such a location could result in one or more of the bits being erroneously detected (e.g., if the plate 706 is stopped such that edges of holes are aligned with the line of sight between LED and sensor) and thereby result in an incorrectness in the detected beam direction. Consequently, use of an ordinary binary code may impose an ambiguity as regarding the actual beam direction since one or more misinterpreted bits may result in a substantial difference in the output beam direction detection. As stated above, a Gray code solves this problem by changing only one bit at a time. Thereby, the ambiguity is at most one position. As is obvious, any number of bits may be used, the more bits, the higher resolution in the detected beam direction. Further, instead of using a plurality of light sources a single light source could be used. Also, the circuit card 708 could be exchanged for signal reflecting means such as a mirror, in which case both sensor and signal transmitter is located in the data card 709. As is also to be understood, any suitable means for generating the binary signals could be used, e.g., ultra sound or a laser beam.

Figure 8:
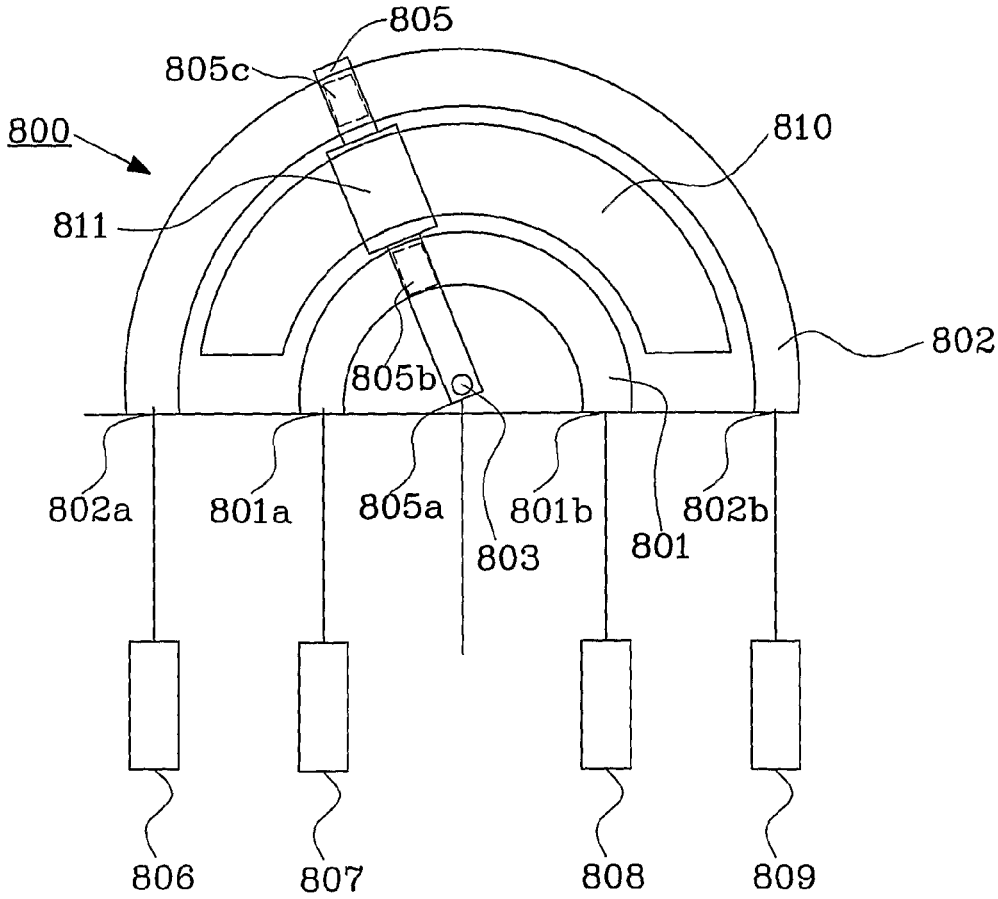
FIG. 8 shows a further alternative exemplary embodiment of the present invention.

In FIG. 8 is shown a further embodiment of the present invention, similar to the one shown in FIG. 7*a-c* but intended for phase shifters wherein a rotatable arm is used to impose a phase shift by differentially changing the physical path length of circle segment striplines. As can be seen in the figure, the phase shifter 800 comprises an inner stripline segment 801 and an outer stripline segment 802 arranged concentrically around a common centre point 803. The ends 801*a-b*, 802*a-b* of the stripline segments 801, 802 are connected to antenna elements 806-809, such as dipole or patch antenna elements for providing a uniform phase shift between two consecutive elements. The uniform phase shift is accomplished by a rotatable feeder arm 805, having at one end 805*a* a central feeding terminal for connection of the RF signal to be fed to said antenna elements, and tapping elements 805 *b, c* (indicated by dashed portions) for providing the RF signal to said striplines 801, 802. When the arm 805 is rotated about said centre point 803, e.g. by an electric motor, the physical path lengths from the tapping points 805*b*, 805*c* to said antenna elements are varied, and by selecting suitable radii of the stripline segments it can be ensured that the path length difference, and thereby phase difference between two consecutive antenna elements are always the same. As can be understood, it would be highly appreciated to always be aware of the exact position of the arm 805, and thereby the beam direction of a beam radiated from said antenna elements. The present invention makes this possible by providing a Gray coded circle segment plate 810, which is arranged on the outside (or, if available space permits, inside) the phase shifter housing. A second arm, arranged on the rotation axis of the arm 805 may be arranged to rotate with and aligned with the arm 805 and comprise a data card of the kind disclosed in FIG. 7. In this example, the data card preferably includes both signal transmitter and sensor since in this instance the Gray coded plate is fixed and the data card moves with the arm. Otherwise a set of diodes would be needed for each position. Consequently, each hole in the plate should be provided with a reflective bottom for reflecting, e.g., signals from said signal transmitter. In the embodiment with a second arm, this second arm, and consequently the Gray coded plate, may be arranged outside the phase shifter housing, and the absolute position can be detected similarly to what has been disclosed in FIG. 7. Alternatively, and as is shown in FIG. 8, no second arm is used but the data card 811 is arranged on the arm 805 instead, preferably on the side facing away from the striplines or in the area between the strip lines. In this way, only one arm is needed and the Gray coded plate 810 could be arranged within the phase shifter housing.

Figure 9:
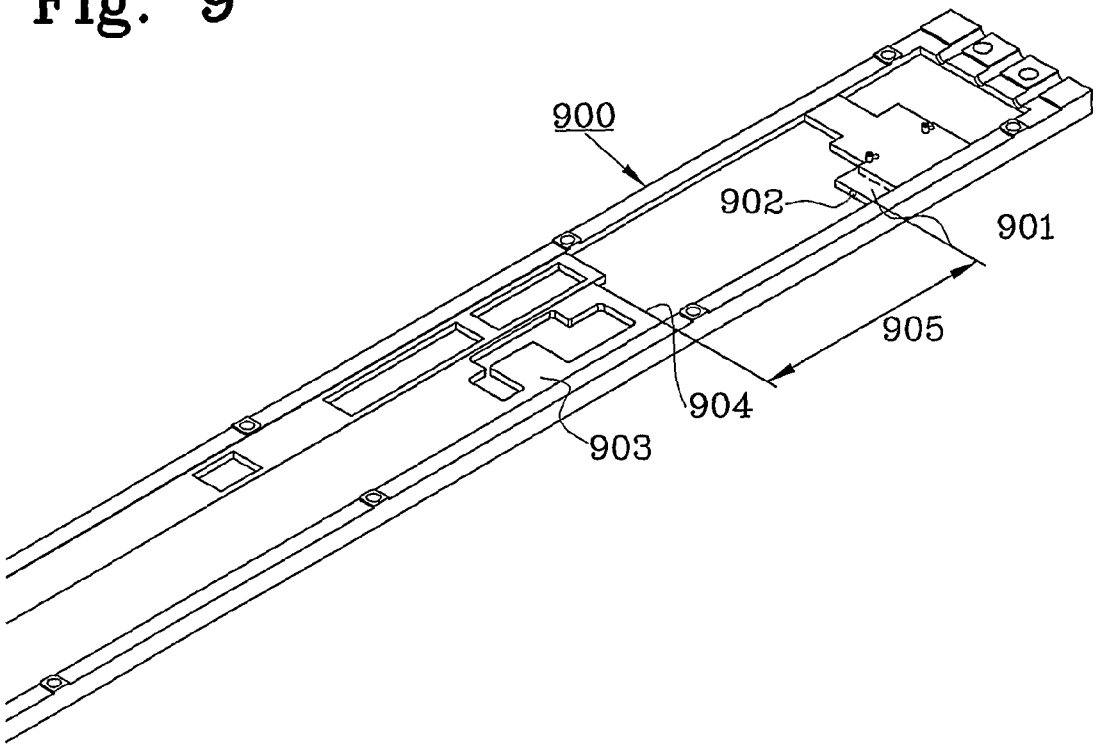
FIG. 9 also shows an alternative exemplary embodiment of the present invention.

In FIG. 9 is shown an even further exemplary embodiment of obtaining absolute position detection of a linearly movable slide of the kind described in FIG. 1 or 4*a*. In FIG. 9 is shown a portion of a phase shifter 900 of the kind disclosed in FIG. 1 (preferably provided with a tooted pinion for dielectric element operation according to FIG. 4*a*). The disclosed phase shifter 900 is provided with a distance sensor 901 having means for transmitting and receiving a signal, e.g., a laser signal 902 directed towards the movable dielectric element 903. The movable dielectric element, on the other hand may where appropriate depending on the kind of signal used, be provided with a reflective coating on its edge 904 towards the distance sensor 901. In use, a signal is transmitted from the distance sensor 901 towards the edge 904 and whereat it is reflected. By measuring the time from transmitting the signal to reception of said signal the distance 905 can be accurately measured. The measured distance may then be provided to an exterior control unit for translation into a tilt angle of the beam radiated from the antenna elements connected to the phase shifter 900. As is obvious to a person skilled in the art, all the above described ways of controlling the actual beam tilt are IC applicable on all described phase shifter embodiments.

Figure 6:
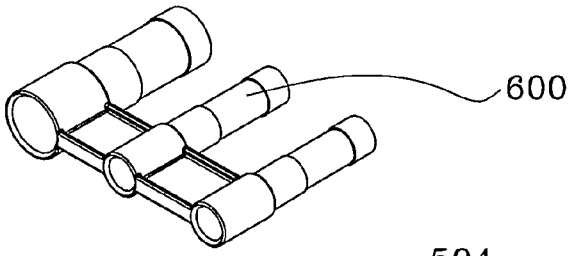
FIG. 6 shows another further feature of the present invention.

FIG. 4*a* also discloses a further advantageous feature of the present invention. A common problem with known phase shifters is that the respective cables to be connected to the device are soldered to the feed line terminals and housing. The soldering of a wire to the feed line terminals does not constitute a problem. However, the requirements of the soldering of the wire sheath to the housing are so rigorous, e.g. in order to control intermodulation, that, in practice, it is impossible to perform such soldering on site. Therefore, when a device is malfunctioning, there is no alternative but to replace the device and the cables soldered thereto. According to the present invention, however, the wire sheath of cables that are to be connected to the device are soldered to a cable shoe 600, shown more in detail in FIG. 6, in a controlled manner during the manufacturing process, and when the device is assembled, the cable shoe is releasably held in position by the screw joint of the upper and lower ground planes, and only the center conductor, the connection of which not being as critical as the ground connection, needs to be soldered to the device. In order to provide a satisfactory ground connection with controlled intermodulation without soldering, the cable shoe and/or the ground planes could be provided with an isolating layer, e.g. by anodization, to secure that a fully capacitive coupling of the ground is obtained. Consequently, a device can be disassembled and assembled and parts be replaced while the performance of the device is retained without having to perform precision soldering on site. As an alternative to the capacitive coupling of the ground as disclosed above, a conductive coupling may be used as well. In such a solution, a separate cable shoe for each cable may be used, and the cable shoe may be formed with an external thread and screwed into corresponding threads in the device housing. The cable shoe solution is, of course, also applicable on the device in FIGS. 1-3.

As also is obvious to a person skilled in the art, a number of other implementations, modifications, variations and/or additions can be made to the above described examples, and it is to be understood that the invention includes all such implementations, modifications, variations and/or additions which fall within the scope of the claims.

For example, the central source connection terminal may itself serve as a feed connection terminal for direct connection to an antenna element.

The proportions in the figures are for illustrative purposes only, and it is to be understood that in reality, the thickness of the dielectric elements may be considerably thinner, and, accordingly, the total thickness of the device also being thinner.

In the above described embodiment, the device includes five feed line segments. It is to be understood however, that the device may comprise more or less than five feed line segments, e.g. four or two.

The invention claimed is:

1. Device for adjusting the beam direction of a beam radiated from a stationary array of antenna elements, wherein at least two antenna element feed points are coupled to a common signal source via a feed line structure having a source connection terminal to be connected to said source and at least two feed connection terminals to be connected to said antenna element feed points, said feed line structure being at a distance from and in parallel to a fixed ground plane on at least one side of said feed line structure, wherein a movable element is located adjacent to said feed line structure so as to change the signal phase of signal components being transferred between said source connection terminal and the respective feed connection terminals, said movable element being movable for effecting a controlled phase shift of said signal components so as to adjust said beam direction, wherein said device is provided with detection means for detecting the absolute position of the movable element, wherein said movable element is provided with a reading scale, and wherein an optical reading device is mounted on the exterior of the device to scan the reading scale through one or more openings in the device.

2. Device according to claim 1, wherein said movable element is provided with a linear potentiometer, so as to allow an exact position of the movable element to be obtained by measuring the resistance of the potentiometer.

3. Device according to claim 1, wherein said means comprises means for detecting the position of the movable element by detecting a capacitance or an inductance.

4. Device according to claim 3, wherein said means comprises a transformer, wherein a voltage can be induced in a secondary coil by movement of a magnetic material rod, said movement of the rod representing the movement of the movable dielectric element, such that the position of the movable dielectric element can be determined by detecting the induced voltage in the secondary coil.

5. Device according to claim 1, wherein it further includes:

means for measuring a distance to said movable element from a fixed position, said distance increasing or decreasing during movement of said movable element, said distance being arranged to represent the beam direction of a radiated beam.

6. Device according to claim 1, wherein it further comprises a coded element and means for reading a code of said coded element, said code representing the position of the movable element.

7. Device according to claim 6, wherein said coded element being arranged to move with said movable element and relative to said code reading means.

8. Device according to claim 7, wherein said coded element being fixed and said code reading means being arranged to move with said movable element and relative to said coded element.

9. Device according to claim 6, wherein said coded element is a binary Gray coded element of n bits.

10. Device according to claim 6, wherein said code is accomplished by recesses or holes in a plate.

11. Device according to claim 6, wherein code reading means comprises means for reading a signal of any from the group: light emitting diode, laser beam, ultra sound or infrared sound.

12. Device according to claim 1, wherein the movable element is provided with means for engagement with a pinion, so that a rotation of the pinion causes a movement of the movable element.

13. Device according to claim 12, wherein a shaft of the pinion extends through a ground plane so as to be engageable from the exterior of the device.

14. Device according to claim 13, wherein it comprises a coded element and means for reading a code of said coded element, said code representing the position of the movable element, wherein said coded element or code reading means is arranged to move with said movable element by means of said pinion.

15. Device according to claim 1, wherein said feed line structure is a planar feed line structure elongated in a main direction.

16. Device according to claim 1, wherein said movable element is a dielectric movable element and located between said feed line structure and the ground plane, said dielectric element being movable in a main direction.

17. Device according to claim 1, wherein said movable element is located between said feed line structure and the ground plane.

18. Device according to claim 1, wherein it further comprises electromechanical means for moving said movable element, said electromechanical means being arranged to be remotely controlled.

19. Device according to claim 18, wherein said electromechanical means comprises an electric motor and a mechanism for transferring an axial rotation into linear movement of a linearly movable element.

20. Device according to claim 1, wherein it is arranged for receiving a cable shoe attached to a cable comprising a conductor and a sheath, so as to allow the sheath of the cable to be connected to the ground planes via the cable shoe by a capacitive coupling or a conducting screw joint.

21. Device according to claim 1, wherein the device is configured with at least four line segments extending from said source connection terminal to said feed connection terminals, with at least a first line segment and a second line segment extending generally in a first direction along a main direction, at least a third and fourth line segment extending generally in a second direction being opposite to said first direction, wherein said movable element being located adjacent to at least part of said first and second line segments and said third and fourth line segments, respectively, and having an effective dielectric value, and said movable element being linearly displaceable between two end positions while keeping said element in proximity to the respective pairs of oppositely extending line segments.

22. An antenna control system for adjusting the beam direction of an antenna array, in particular of an antenna array constituting part of a base station in a mobile cellular communication system, said antenna array comprising a plurality of antenna elements and phase shifting means for varying the phase of at least one signal being fed to said antenna elements, wherein adjustment of said phase of said signal is achieved by actuating an operating element, and wherein actuation of said operating element is achieved by operating an operating element actuator, wherein the phase shifting means comprises a device according to claim 1.

23. Antenna control system according to claim 22, wherein the operating element actuator consists of an electric motor with associated control electronics.

24. Antenna control system according to claim 23, wherein the electric motor is connected to the shaft of a pinion being engageable from the exterior of the device, wherein the operating element is provided with means for engagement with said pinion, so that a rotation of said pinion by the electric motor, causes a movement of the operating element.

25. Antenna control system according to claim 23, wherein the control electronics comprise input means for receiving command signals transmitted from a remote control unit, means for converting command signals intended for an antenna unit into a corresponding control signal for said electric motor, and means for controlling said electric motor based on the control signal in order to displace the operating element so as to make a corresponding adjustment of said phase of said signal at each antenna element, thereby remotely controlling the general angular direction of a main lobe.

* * * * *